United States Patent [19]

Haag et al.

[11] 3,954,060

[45] May 4, 1976

[54] PROJECTILE

[75] Inventors: Charles W. Haag; John Metz, Jr.; John J. Voda, all of Evansville, Ind.

[73] Assignee: The United States of America as represented by the Secretary of the Army, Washington, D.C.

[22] Filed: Aug. 24, 1967

[21] Appl. No.: 665,192

[52] U.S. Cl. ..... 102/69; 102/7.2; 102/34.4; 102/67; 102/DIG. 7

[51] Int. Cl.² ..... F42B 13/50

[58] Field of Search ..... 102/92.4, 58, 69, 7.2, 102/37.6, 49.5, 34.4, 5, DIG. 7

[56] References Cited

UNITED STATES PATENTS

| | | | |
|---|---|---|---|
| 965,278 | 7/1910 | Brust | 102/DIG. 7 |
| 1,203,649 | 11/1916 | Papuga | 102/DIG. 7 |
| 1,274,419 | 8/1918 | Jackson | 102/58 |
| 1,340,871 | 5/1920 | Barker et al. | 102/69 |
| 2,476,973 | 7/1949 | Gillon | 102/7.2 |
| 2,809,583 | 10/1957 | Ortynsky et al. | 102/7.2 |
| 3,093,072 | 6/1963 | Pigman | 102/7.2 |
| 3,095,814 | 7/1963 | Jansen et al. | 102/37.6 |
| 3,172,330 | 3/1965 | Lidmalm et al. | 102/7.2 |
| 3,318,241 | 5/1967 | Gould | 102/58 |

FOREIGN PATENTS OR APPLICATIONS

| | | | |
|---|---|---|---|
| 684,953 | 7/1930 | France | 102/DIG. 7 |

*Primary Examiner*—Verlin R. Pendegrass
*Attorney, Agent, or Firm*—Nathan Edelberg; Robert P. Gibson; A. Victor Erkkila

[57] ABSTRACT

A projectile having a first plurality of flechettes arranged to be dispersed during the flight of the projectile by an explosive removal of a surrounding portion of the projectile casing and a second plurality of flechettes adapted to be subsequently dispersed by a movement thereof forwardly through a rear portion of the casing of the projectile and subsequent lateral displacement therefrom.

20 Claims, 8 Drawing Figures

INVENTORS
CHARLES W. HAAG
JOHN METZ JR.
JOHN J. VODA
BY Hofgren, Wegner, Allen, Stellman & McCord.
ATTORNEYS.

PROJECTILE

This invention relates to projectiles and in particular to projectiles having fin-stabilized fragments for anti-personnel and anti-materiel effect.

One form of anti-personnel and anti-materiel projectile comprises a fin-stabilized flechette which may be formed as a small wire element having a pointed end and a finned rearward end for stabilizing the flechette with the nose end disposed forwardly in flight. The present invention comprehends an improved projectile structure adapted to carry a plurality of groups of such flechettes for seriatim dispersion from the projectile in a conical distribution for improved anti-personnel and anti-materiel effect.

Thus, a principal feature of the present invention is the provision of a new and improved projectile utilizing fin-stabilized fragments.

Another feature of the invention is the provision of such a projectile provided with a plurality of groups of flechettes to be dispersed seriatim from the projectile for improved anti-personnel and anti-materiel effect.

Still another feature of the invention is the provision of such a projectile comprising a casing having a nose, a front portion defining a front bay, and a rear portion defining a rear bay, a first plurality of flechettes in the front bay, a second plurality of flechettes in the rear bay, means for separating the front portion from the projectile in flight to expose the front bay and free the first plurality of flechettes for flight independently of the casing, and means for ejecting the second plurality of flechettes forwardly and outwardly from the second bay for flight independently of the casing.

A further feature of the invention is the provision of such a projectile wherein means are provided for explosively removing the front portion of the casing for dispersion of the flechettes therein as an incident of the rotational spin of the projectile.

Another feature of the invention is the provision of such a projectile wherein the ejecting means comprises a propellant means.

Still another feature of the invention is the provision of such a projectile wherein means are provided extending through the second plurality of flechettes for actuating the propellant ejecting means subsequent to the dispersion of the first plurality of flechettes.

A yet further feature of the invention is the provision of such a projectile wherein means are provided for removably connecting the front portion and rear portion of the casing.

Still another feature of the invention is the provision of such a projectile including means for visually indicating the time of separation of the first plurality of flechettes from the projectile and indicating the trajectory of the casing nose.

Other features and advantages of the invention will be apparent from the following description taken in connection with the accompanying drawing wherein.

Figure 3:
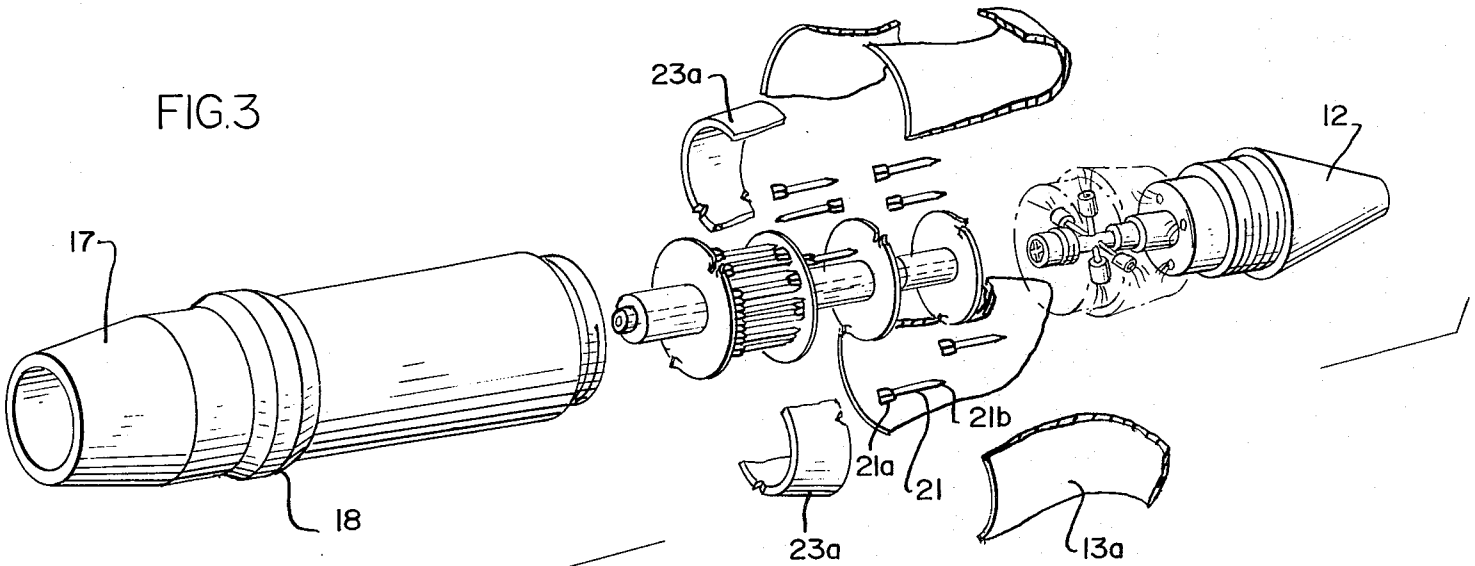
FIG. 3 is an exploded isometric view of the projectile upon separation of the front portion of the casing and first plurality of flechettes from the projectile.
Figure 4:
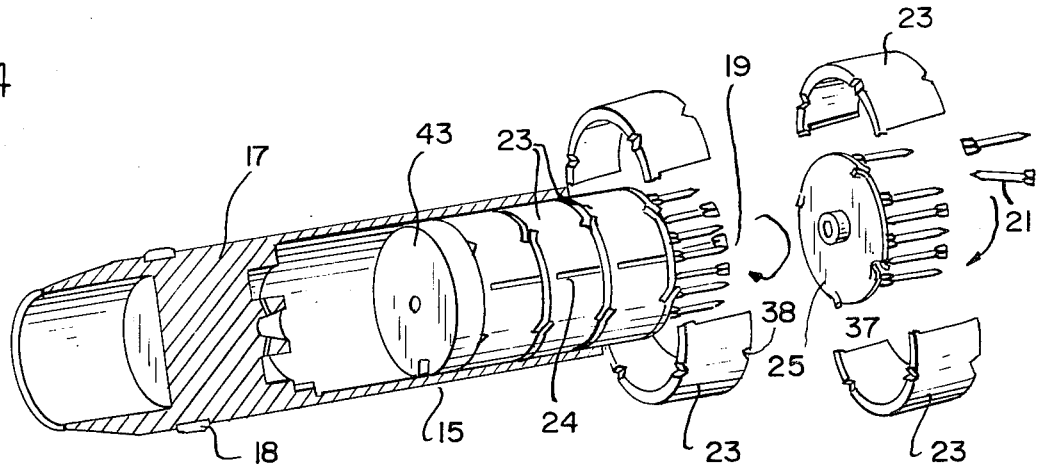
FIG. 4 is a fragmentary isometric view partially in diametric section illustrating the ejection of the second plurality of flechettes forwardly from the rear portion of the casing.
Figure 2:
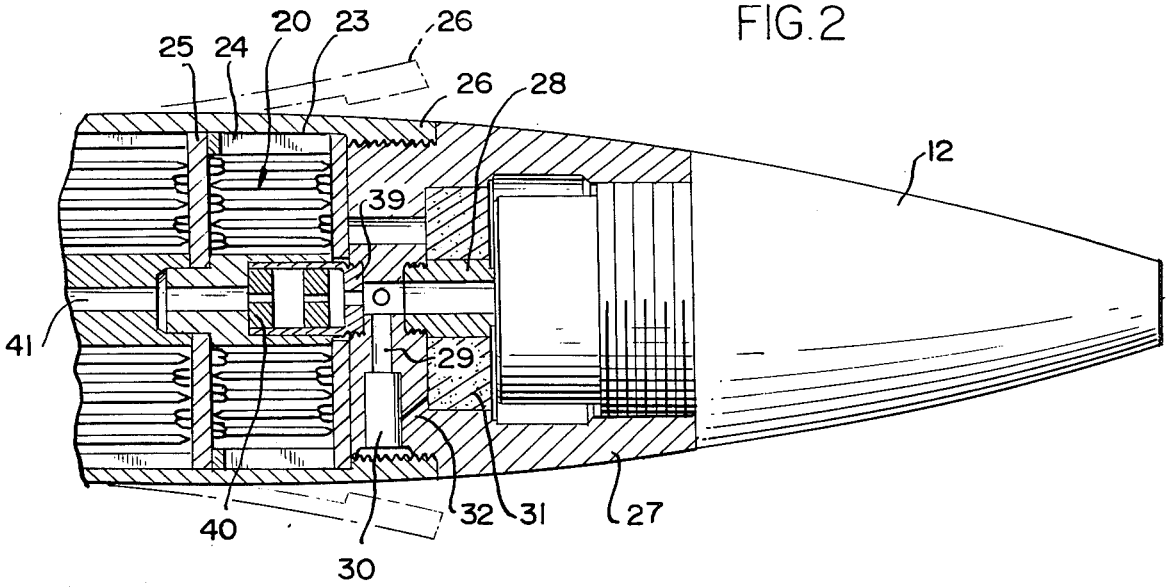
FIG. 2 is a fragmentary enlarged diametric section of the forward portion of the projectile with the splittable casing shown in broken lines in an initial deformed arrangement.
Figure 5:
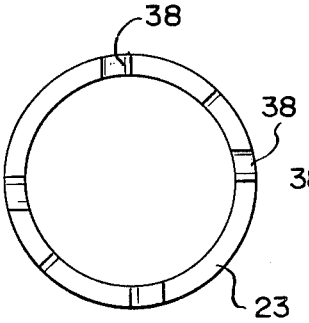
FIG. 5 is an end elevation of an outer spacer of the bay.
Figure 6:
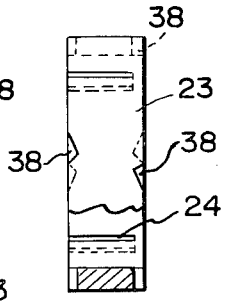
FIG. 6 is a side elevation thereof partially in diametric section.

In the exemplary embodiment of the invention as disclosed in the drawing, a projectile generally designated 10 is shown to comprise a casing generally designated 11 having a nose 12, a front portion 13 defining a front bay 14, a rear portion 15 defining a rear bay 16, and a base 17. The base carries a conventional rotating band 18 which is adapted to cooperate with the internal rifling of the launching tube to impart a spin about the longitudinal axis 19 of the projectile in flight. A first plurality 20 of flechettes 21 is disposed in the front bay 14 and a second plurality 22 of flechettes 21 is provided in the rear bay 16. The front portion 13 of the casing 11 is arranged to be separated from the projectile in flight to expose the front bay 14 which when thusly exposed fragmentizes and effects a dispersion of the plurality 20 of flechettes 21 as illustrated in FIG. 3. The second plurality 22 of flechettes is caused to be ejected from the rear bay 16 by a movement forwardly therefrom as illustrated in FIG. 4 subsequent to the separation of the first plurality 20 of front bay 14.

More specifically, each of the flechette pluralities 20 and 22 is carried in tiers to withstand the stresses on the projectile during firing without deformation of the flechettes. Thus, as shown in FIGS. 3 and 5 through 8, the projectile tiers comprise a plurality of annular spacers 23 provided with partial, longitudinal splits 24 and separator discs 25. The front casing 13 is provided with a front end 26 threadedly connected to a rear portion 27 of the nose 12 which defines a fuse providing a flash or flame output passing rearwardly through a flash tube 28 and radially outwardly through radial passages 29 to ignite a plurality of detonators 30 directed outwardly against the threaded portion 26 of the casing portion 13. The explosion of the detonators 30 causes casing 13 to split and deform radially outwardly until the entire casing portion 13 is split into a plurality, herein four or more, longitudinal segments **13*a* as shown in FIG. 3. Once the casing portion 13 is thusly separated from the projectile, the centrifugal force developed by the spin of the projectile causes the annular spacers 23 to break into a plurality of segments 23*a*, as shown in FIG. 3, thereby to release the flechettes 21** which move laterally outwardly under the centrifugal action of the spinning projectile to be dispersed in a generally conical pattern as individual fragments.

Figure 1:
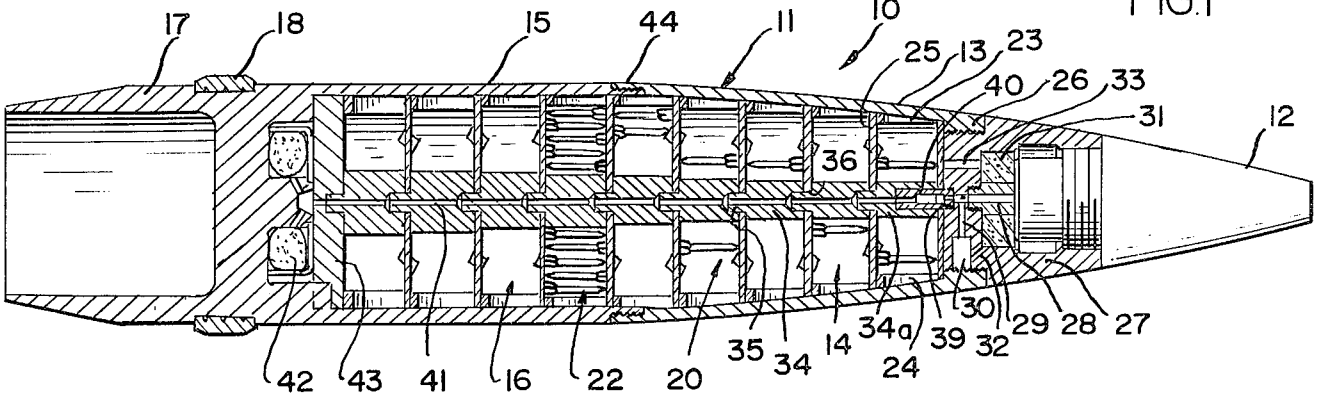
FIG. 1 is a diametric section of a projectile embodying the invention.
Figure 7:
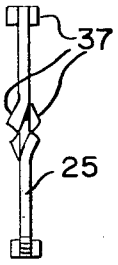
FIG. 7 is a side elevation of a support plate of the bay.
Figure 8:
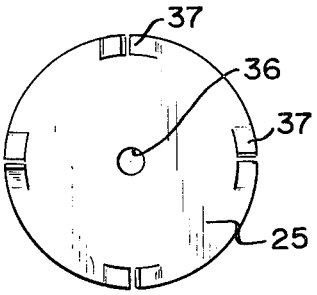
FIG. 8 is a front elevation thereof.

The nose fuse 12 is set in the conventional manner to provide the igniting flash at a preselected time in the flight of the projectile. The rear portion 27 of the fuse may be provided with a marker pellet 31 which is ignited from the detonator 30 through a plurality of igniter holes 32 and which burns through a plurality of escape holes 33 in the nose portion 27 to indicate the time of operation of the fuse as well as to mark the trajectory of the fuse and indicate the location of ground impact thereof. As shown in FIGS. 1 and 3, the tiers are further defined by a plurality of inner spacers 34 connected end-to-end axially of the projectile by means of projections 35 extending through axially openings 36 in spacer discs 25. As shown in FIGS. 7 and 8, the spacer discs are provided with a plurality of projecting tabs 37 which interlock with corresponding recesses 38 in the outer annular spacers 23 to key the tier elements together during the flight of the projectile and thereby prevent slippage of the flechettes pluralities 20 and 22 during flight.

As illustrated in FIGS. 1 and 3, the flechettes 21 may be arranged alternately nose end forward and nose end rearward in the bay 14. The fins 21*a* cause the flechettes to quickly orient themselves with the nose end 21*b* forwardly upon release thereof from the projectile. When the annular spacers 23 split apart as shown in FIG. 3 as an incident of the removal of the outer casing portion 13, the separator discs 25 and the spacers 23 and 34 quickly separate to comprise additional fragmentation. The inner spacers 34 are not keyed together and thus readily separate upon the dispersion of the flechettes and outer spacers 23.

At the time the fuse 12 causes explosion of the detonators 30, it concurrently ignites a relay 39 in the rear end of the fuse portion 27 which in turn ignites a detonator 40 in the forward spacer 34*a*. The spacers 34 define a serially continuous axial passage 41 through the bays 14 and 16 through which the detonator 40 flashes to ignite a propellant 42, herein an explosive powder charge, in the base 17. The burning of charge 42 urges a pusher disc 43 forwardly through the rear casing portion 15 to urge the second plurality 22 of flechettes forwardly from the casing portion 15 as shown in FIG. 4 whereupon the outer spacers 23 thereof split apart to release the flechettes 21 for laterally outward movement as an incident of the centrifugal forces generated therein by the spin of the projectile. Thus, the second plurality 22 of flechettes 21 is dispersed in a manner generally similar to the dispersion of the first plurality 20. However, there is a preselected time delay between the dispersion of the first plurality 20 and the second plurality 22 to provide a substantially continuous dispersion of flechettes with minimum interference from the supporting spacers 23 and 34 and separator discs 25.

The front casing portion 13 may be threadedly connected to the rear portion 15 as at 44 for facilitated assembly of the projectile. The forming of the central spacers 34 as a segmented series further facilitates the assembly of the individual tiers of flechettes and provides additional lethal fragmentation upon separation thereof from the projectile as discussed above.

Thus, the projectile 10 provides an improved functioning wherein improved dispersion of a plurality of flechettes is provided over an extended period of time. The projectile is readily assembled because of the tiered construction and the threaded association of the several casing portions and fuse, or nose, structure. The frangible construction of the spacers and forward casing portion provides facilitated dispersion of the flechettes at the time of release, while yet effectively maintaining the assembled relationship thereof in the projectile during firing and initial flight thereof. The projectile may be utilized with substantially all calibers of artillery ammunition and weapon systems employing fragmentation warheads. By suitably controlling the timing of the fuse ignition, effective performance of the projectile may be selected at any point in range from the muzzle of the firing weapon out to the maximum range of conventional artillery weapon systems. The dispersion pattern may be readily adjusted for optimum effectiveness by suitable correlation of the forward velocity of the projectile to the velocity of spin.

While we have shown and described one embodiment of our invention, it is to be understood that it is capable of many modifications. Changes, therefore, in the construction and arrangement may be made without departing from the spirit and scope of the invention as defined in the appended claims.

We claim:

1. Projectile means comprising:

a casing having a nose, a front portion defining a front bay, and a rear portion defining a rear bay;

a first plurality of flechettes in said front bay;

a second plurality of flechettes in said rear bay;

means for separating said front portion from the projectile in flight to expose said front bay and free said first plurality of flechettes for flight independently of said casing; and means for ejecting said second plurality of flechettes forwardly and outwardly from said second bay for flight independently of said casing.

2. The projectile means of claim 1 including means for imparting a spin to the projectile about the longitudinal axis thereof as an incident to the firing thereof and means for carrying said first plurality of flechettes in said front bay arranged to release said first plurality for radially outward movement as a result of the centrifugal force developed therein by said spin upon separation of said front casing portion from the projectile.

3. The projectile means of claim 1 wherein said separating means comprises means for splitting said front casing portion into a plurality of sections.

4. The projectile means of claim 1 wherein said separating means includes explosive means for deforming said front casing portion radially outwardly while allowing said rear casing portion to remain substantially intact.

5. The projectile means of claim 1 wherein said ejecting means comprises propellant means and means for causing said propellant means to eject said second plurality of flechettes subsequent to the separating of the front casing portion from the projectile.

6. The projectile means of claim 1 including means for imparting a spin to the projectile about the longitudinal axis thereof as an incident to the firing thereof and means for carrying said second plurality of flechettes in said rear bay arranged to release said second plurality for radially outward movement as a result of the centrifugal force developed therein by said spin upon ejection of said second plurality of flechettes to forwardly of said rear casing portion.

7. The projectile means of claim 1 including means for mounting said flechettes in a plurality of tiers in said rear bay.

8. The projectile means of claim 1 including means for mounting said flechettes in a plurality of tiers in said rear bay and said ejecting means ejects said tiers successively from said rear bay.

9. The projectile means of claim 1 wherein each of said separating and ejecting means comprises explosive means, and means are provided for igniting the ejecting explosive means as an incident of the igniting of the separating explosive means.

10. The projectile means of claim 1 wherein said ejecting means includes propellant means rearwardly of said rear bay and means extending longitudinally of the projectile through said rear bay for actuating said propellant means.

11. The projectile means of claim 1 including means for mounting said flechettes in a plurality of tiers in said rear bay, said ejecting means includes propellant means rearwardly of said rear bay and means extending longitudinally of the projectile through said mounting means for actuating said propellant means.

12. The projectile means of claim 11 wherein said mounting means defines a segmented flash tube arranged to form a plurality of separate fragments upon ejection thereof from said rear bay.

13. The projectile means of claim 1 including means for mounting said flechettes in a plurality of tiers in said rear bay, said mounting means comprising a plurality of separable sections interlocked in assembled relationship in said rear bay and arranged to form a plurality of separate fragments upon ejection thereof from said rear bay.

14. The projectile means of claim 1 including threaded means connecting said front casing portion to said rear casing portion.

15. The projectile means of claim 1 including means for visually indicating substantially the time of separating of said first plurality of flechettes from the projectile.

16. The projectile means of claim 1 including means for visually indicating the trajectory of the casing nose subsequent to said ejection.

17. The projectile means of claim 1 wherein said separating means comprises means for splitting said front casing portion longitudinally of the projectile.

18. The projectile means of claim 1 wherein said ejecting means includes a pusher movable forwardly through said rear bay and arranged to form a separate fragment upon ejection thereof from said rear bay.

19. The projectile means of claim 1 wherein said separating means comprises explosive means and said ejecting means comprises ignitable propellant means, and further including fuse means for igniting said explosive means, and means for igniting said propellant means selectively by said fuse means or as an incident of the igniting of said explosive means.

20. The projectile means of claim 1 wherein said separating means comprises explosive means and said ejecting means comprises ignitable propellant means, and further including fuse means for igniting said explosive means, means for igniting said propellant means by the fuse means, and passage means communicating between said explosive means and said propellant means for igniting said propellant means as an incident of the igniting of said explosive means in the event said means for igniting said propellant means by the fuse fails to ignite said propellant means.

* * * * *